US005417506A

United States Patent [19]

Eenigenburg et al.

[11] Patent Number: 5,417,506

[45] Date of Patent: May 23, 1995

[54] APPARATUS FOR REMOVING AND VIEWING SELECTED DOCUMENTS FROM FILE FOLDERS

[76] Inventors: John M. Eenigenburg, c/o 1618 Stanford Unit A; Laurence N. Neber, 1618 Stanford Unit A; James B. Riordan, c/o 1618 Stanford Unit A, all of Santa Monica, Calif. 90404

[21] Appl. No.: 322,263

[22] Filed: Oct. 13, 1994

[51] Int. Cl.[6] ..... B42F 13/00

[52] U.S. Cl. ..... 402/7; 402/15; 402/41; 402/80 R; 402/68

[58] Field of Search ..... 402/7, 15, 18, 24, 25, 402/80 R, 68, 60

[56] References Cited

U.S. PATENT DOCUMENTS

| | | | |
|---|---|---|---|
| 1,275,397 | 8/1918 | Coull et al. | 402/7 |
| 2,270,045 | 1/1942 | Goldsmith | 402/68 |
| 4,084,911 | 4/1978 | DeWitt | 402/15 |
| 4,632,586 | 12/1986 | Erickson | 402/7 |
| 5,169,255 | 12/1992 | Jensen | 402/24 |

FOREIGN PATENT DOCUMENTS

| | | | |
|---|---|---|---|
| 173081 | 12/1921 | United Kingdom | 402/7 |

*Primary Examiner*—Willmon Fridie

[57] ABSTRACT

An apparatus for viewing and removing selected documents retained in file folders having a flat metallic fastening member. An element (40) is formed comprised of a first arm (50), a second arm (52) and a connecting section (54). Each arm is a solid, cylindrical member which is essentially U-shaped and with a vertical slot (60) in the unconnected end of the arm, which slot is capable of receiving and holding the extended prong (26, 28) of the fastening member (24) of the file folder (20). The upper end of each slot has an inverted syncline cut (72) to hold the tapered end of the extended prong. This apparatus facilitates the viewing of a selected document, the removal of a selected document or documents, or the insertion of an additional document or documents after the overlying documents have been removed and placed onto the apparatus. This apparatus further facilitates the replacement of the removed overlying documents back onto the metallic fastening member.

8 Claims, 11 Drawing Sheets

APPARATUS FOR REMOVING AND VIEWING SELECTED DOCUMENTS FROM FILE FOLDERS

BACKGROUND OF THE INVENTION

1. Field of the Invention

Our invention relates to methods and apparatus for facilitating the viewing or removal of selected, punched papers retained in file folders wherein they are secured by metal fasteners of the type sometimes called Acco fasteners.

2. Description of the Related Art

For many years businesses have relied extensively upon document file folders for maintaining documents in a neat and orderly manner. Document file folders have been produced which include metal fasteners which have their central section connected to the support material of the file folder and are flexible such that their arms or prongs can be bent upward in a parallel relationship so as to accept documents which are hole-punched with the prongs then being bent downward towards the file folder to retain the documents thereon, or the outer ends of the prongs may be interengaged with a retaining device, sometimes called a "compressor", which bears upon the top document and is provided with sliding retainers for retaining the outer ends of the prongs in interengagement with it.

Difficulties arise in the use of conventional fasteners when removing a desired document from a stack of documents fastened in a file folder by said fastener and then restoring the desired document to the stack of papers originally located above the desired documents (called "overlying" documents). This problem is greater, of course, when the selected documents are at or near the bottom of the stack. When the overlying documents are removed from the metal fastener, it is very easy to mis-align the documents such that the paper holes are no longer in alignment. This makes re-insertion of the removed documents back onto the metal fastener difficult. Further, the difficulty is increased when many documents are re-inserted at the same time back onto the metal fastener to their original position in the file folder, as there is a tendency for the fastener prongs to bend because of their malleability.

A further problem with the use of file folders having metal fasteners of the type described herein is that the viewing of a selected document requires the overlying documents to be folded back over the metal fastener, such that the overlying documents extend outside of the file folder in a reverse, inverted position. The documents, however, are still secured by the metal fastener. If there are only a few overlying documents folded back in this manner, they may maintain their reversed, inverted position outside of the file folder, allowing viewing of the selected document, but often the overlying documents must be weighed down in some manner because there is a natural tendency for the overlying clamp, whereby the overlying documents are removed by erecting the fastener prongs, manually raising the overlying documents for removal, and inserting the flat plate between the overlying documents and the selected document, clamping the overlying documents to the flat plate and thereafter together withdrawing the overlying documents and flat plate from the fastener prongs, their holes remaining in alignment. Such a device is disclosed in U.S. Pat. No. 5,169,255. This system is also undesirable. Like the system described in U.S. Pat No. 4,632,586, there is a tendency for the fastener prongs to bend when the flat plate is lowered over the prongs and the removed documents are restored to their original position in the file folder. This contributes to a malformation of the prongs over a period of time. Further, this system requires that the overlying documents be clamped together before they are removed from the fastener prongs. The use of a clamp makes this system less than ideal because it is inconvenient to the average user and because it does not solve the aforementioned problem of enabling the user to view selected documents without having to weigh down the overlying documents.

OBJECTS OF THE INVENTION

Accordingly, it is an object of our invention to provide methods and apparatus for rapidly and easily viewing documents fastened in a file folder by means of a metal fastener without having to weigh down the overlying documents in any manner.

It is a further object of our invention to provide methods and apparatus for rapidly and easily removing overlying documents from a selected document or documents fastened in a file folder by means of a metal fastener, in documents to return to their original position in the file folder. If there are many overlying documents folded over, the problem worsens and it is difficult to view a selected document without holding down the overlying documents by hand or weighing them down in some manner.

Several expedients have been adopted in an attempt to solve the problems with regard to the removal of documents to and from a file folder, and none address the problem of viewing a selected document without the necessity of weighing down the overlying documents once they have been folded over. Such conventional devices include an apparatus having a pair of tubes which are passed over the fastener prongs, whereby the overlying documents can be lifted onto the tubes for removal from the fastener prongs with their holes remaining in alignment. Such devices are described in U.S. Pat. Nos. 4,084,911 and 4,632,586.

For example, the system described in U.S. Pat. No. 4,084,911 is comprised of fasteners which are hollow tubes that are flatter in the middle and heat welded to the file and are utilized in conjunction with a stiff keeper through which the tubes are intertwined for retaining documents on the file. A U-shaped bar having male ends is utilized in conjunction with the two other components. The male ends are slipped into the female ends of the fastener tubes for removal and insertion of documents within the stack of documents in the file.

The shortcomings of this system are set forth in U.S. Pat. No. 4,632,586. Briefly, the amount of space taken up by the fastener and its retaining device, called a keeper, is excessive. The keepers are approximately 3/32 inch thick, which elevates the file to at least ⅜ inch even without a single paper being held in the file. In a single file this may not be critical, but when thousands of files, and even hundreds of thousands of files must be stored for long periods of time, the space taken up by the individual fasteners of the type described in U.S. Pat. No. 4,084,911, when multiplied together, can result in tens, hundreds, or even thousands of feet of expensive file space.

The system described in U.S. Pat. No. 4,632,586 attempts to solve this problem with a device which crimps the ends of the fastener prongs, thereby allowing hollow metal tubes or arms to fit over the crimped ends, said tubes or arms being comprised as one integral U-shaped member having a first arm, a second arm and a connecting section which joins said first and said second arms, and having two essentially 90° bends at the junction point of said first and second arms with said connecting section. These hollow tubes or arms are slipped over the crimped ends of the prongs thereby permitting the overlying documents to be removed upwards and onto the U-shaped member.

This system is undesirable in that it requires a permanent malformation of the ends of the fastener prongs and a device separate from the document removal device for the sole purpose of crimping the ends of the prongs. Further, the hollow metal tubes of the U-shaped member slide down only as far as the prongs are crimped. Because the metal tubes do not fit over the entire length of the prongs, there is a tendency for the prongs to bend when the removed documents are restored to their original position in the file folder. Such a system, therefore, does not provide for easy re-insertion of the removed documents.

Other conventional approaches to the overlying document removal problem include a device which is comprised of a flat plate to which one edge of which is affixed a paper order to rapidly and easily gain access to the selected document or documents for immediate removal from the file folder, or for insertion of an additional document into the file folder.

Another object of our invention is to provide methods and apparatus for rapidly and easily returning the removed overlying documents from the overlying document removal device to their position on top of the remainder of the document stack after the selected document or documents have been removed from the file folder or additional documents have been inserted into the file folder.

Another object of our invention is to provide methods and apparatus for rapidly and easily returning the removed overlying documents from the overlying document removal device to their position on top of the remainder of the document stack without any undesirable bending of the fastener prongs upon re-insertion.

Another object of our invention is to provide methods and apparatus for rapidly and easily removing overlying documents from a selected document or documents fastened in a folder by means of a metal fastener without crimping or otherwise deforming the ends of the prongs of the fastener.

A further object of our invention is to provide methods and apparatus for rapidly and easily removing overlying documents from a selected document or documents fastened in a folder by means of a metal fastener without using any type of clamp for the purposes of clamping down the overlying documents to hold the documents together in order to keep their holes in alignment.

Other objects of our invention will become apparent from a consideration of the ensuing description and drawings.

SUMMARY OF THE PREFERRED EMBODIMENTS

In accordance with an aspect of the present invention, a document removal device comprises first and second arms and a cross member connecting the first arm to the second arm so that the first arm is held in fixed parallel relationship to the second arm. Each of the first and second arms has an outer cross section of a size and shape that conforms to holes formed in documents for storing documents in a file folder. The opening in each arm is formed on an end of the arm disposed away from the cross member, and the opening has an inner cross section suitable for slidably engaging a prong of a file folder fastener.

In accordance with a further aspect of the present invention, the cross member is a flat plate and each of the first and second arms extends in a substantially U-shaped arc from the cross member so that a portion of the opening in the first and second arm is disposed at a height substantially equal to that of the cross member. In another aspect, the opening in each of the first and second arms extends along the arm for a distance at least as long as a prong of a file folder.

Reference Numerals in Drawings

Figure 1:
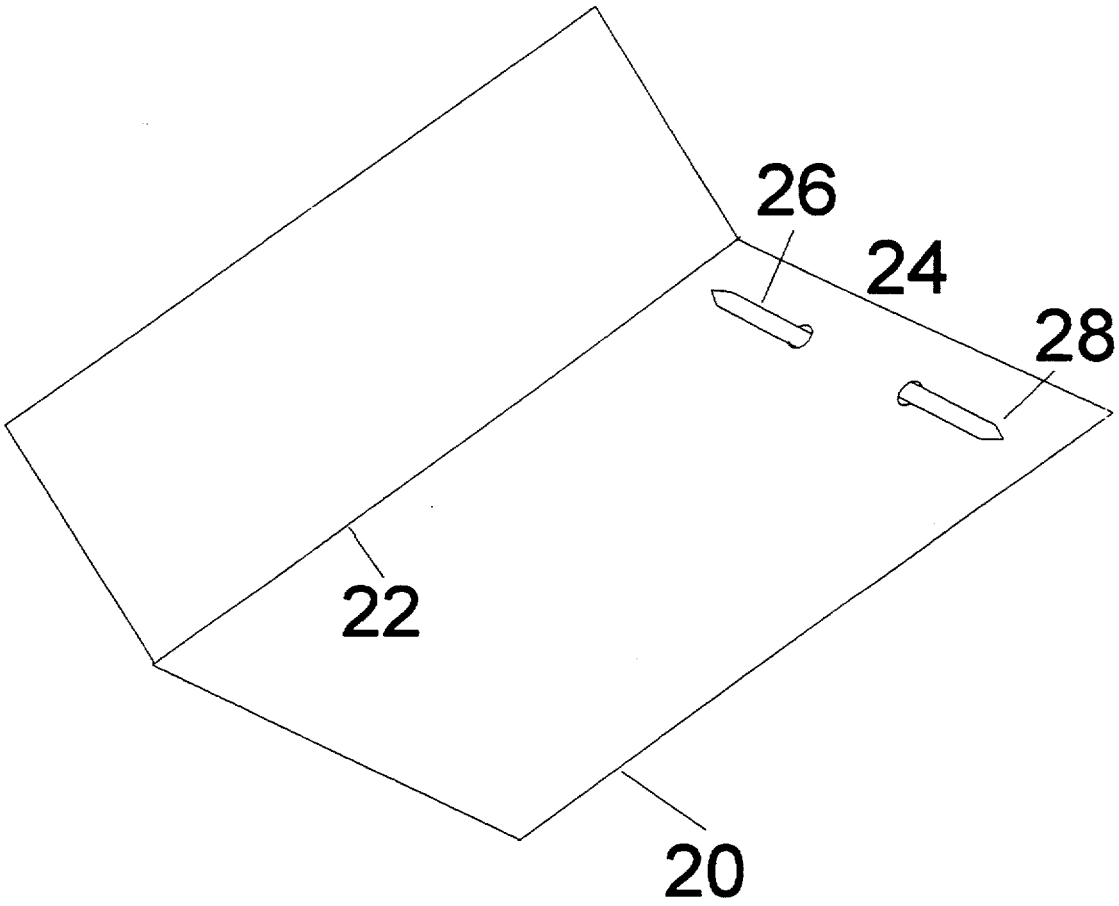
FIG. 1 PRIOR ART
FIG. 1 is a perspective view showing a conventional file folder with the fastener prongs bent downward.

20 file folder
22 crease
24 fastener
26 first prong of fastener
28 second prong of fastener
30 document
32 document holes
40 document removal device
50 first arm of document removal device
52 second arm of document removal device
54 connecting section of document removal device
60 slot
70 element with inverted syncline cut
72 edges of inverted syncline cut

DETAILED DESCRIPTION OF THE PREFERRED EMBODIMENTS

FIG. 1 shows a file folder 20 which is adapted to receive a collection of documents for storage therein. The file folder 20 is generally formed of a heavy paper stock and includes a crease or sometimes accordion-like creases 22 for ease in folding. To complete the file 20 there is a fastener 24. The file 20 shown in FIG. 1 is a typical file which might be used in business.

Figure 2:
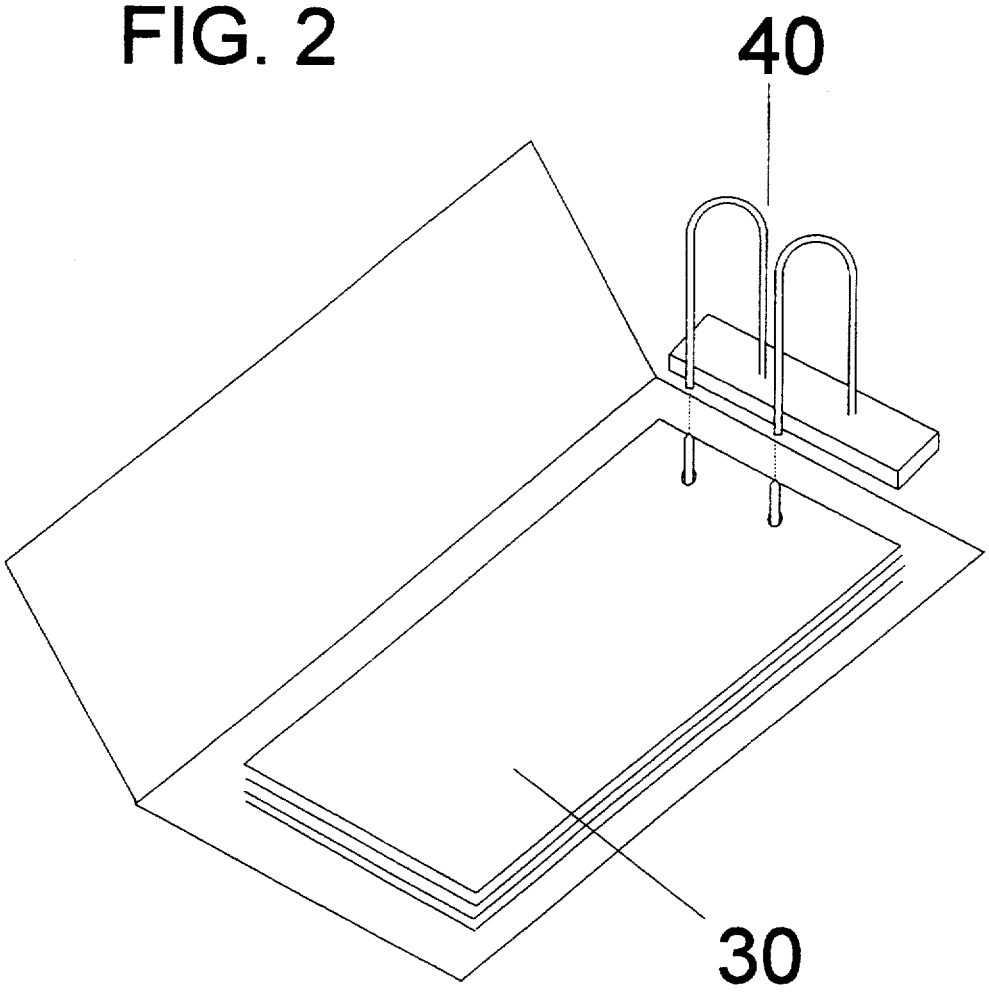
FIG. 2 is a perspective view showing a conventional file folder with the fastener prongs bent upwards and an embodiment of the invention in position for application.

Referring now to FIG. 2, the document 30 has been punched to include two holes, collectively identified by the numeral 32, which allow it to slip over the fastener 24 when the fastener 24 has its respective prongs 26 and 28 bent upwardly as seen in FIG. 2. Also shown in FIG. 2 is an embodiment of the invention, a document removal device 40 in accordance with its arms 50 and 52 positioned over the prongs 26 and 28 for intended operation.

Figure 3:
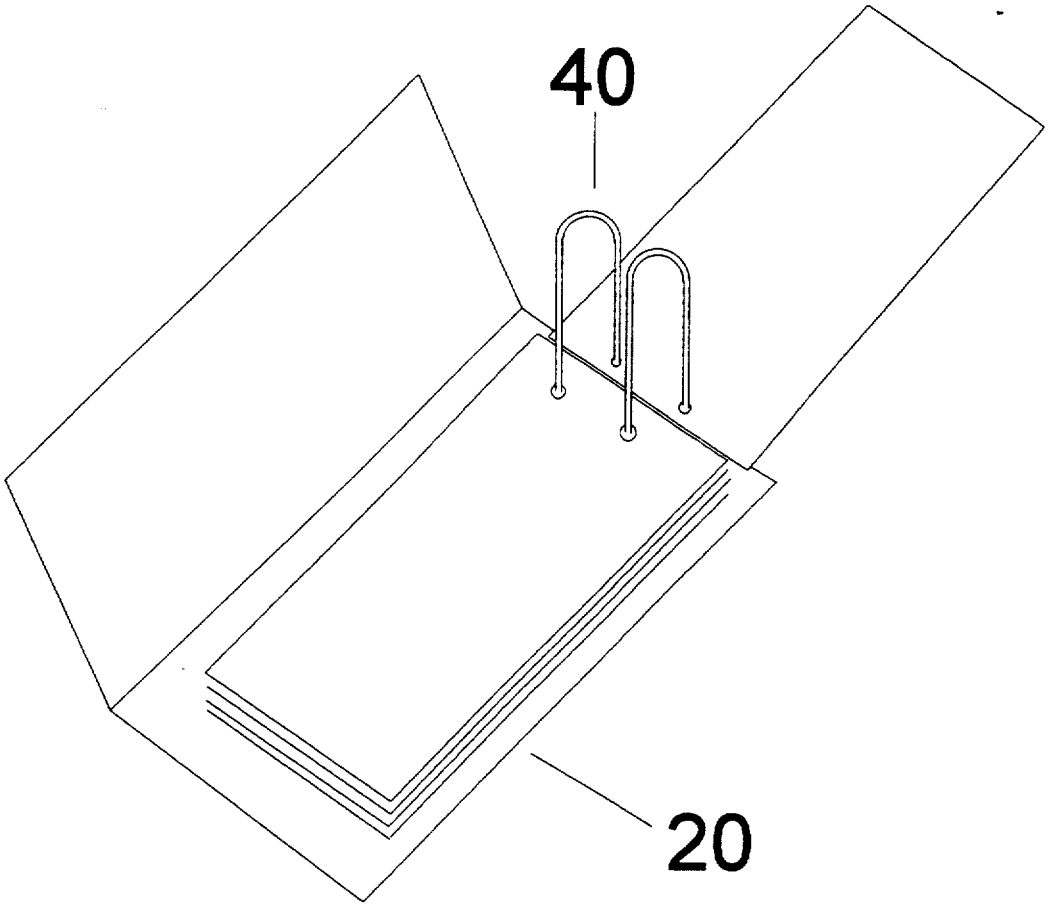
FIG. 3 is a perspective view showing the file folder of FIG. 2 from which a stack of overlying documents has been removed from a file folder in accordance with an aspect of the invention.

Referring now to FIG. 3, the document removal device 40 is shown after it has been engaged with the prongs 26 and 28 of the fastener 24, thereby allowing the overlying documents to be removed from the file folder 20 for viewing or removal of a selected document.

Figure 4:
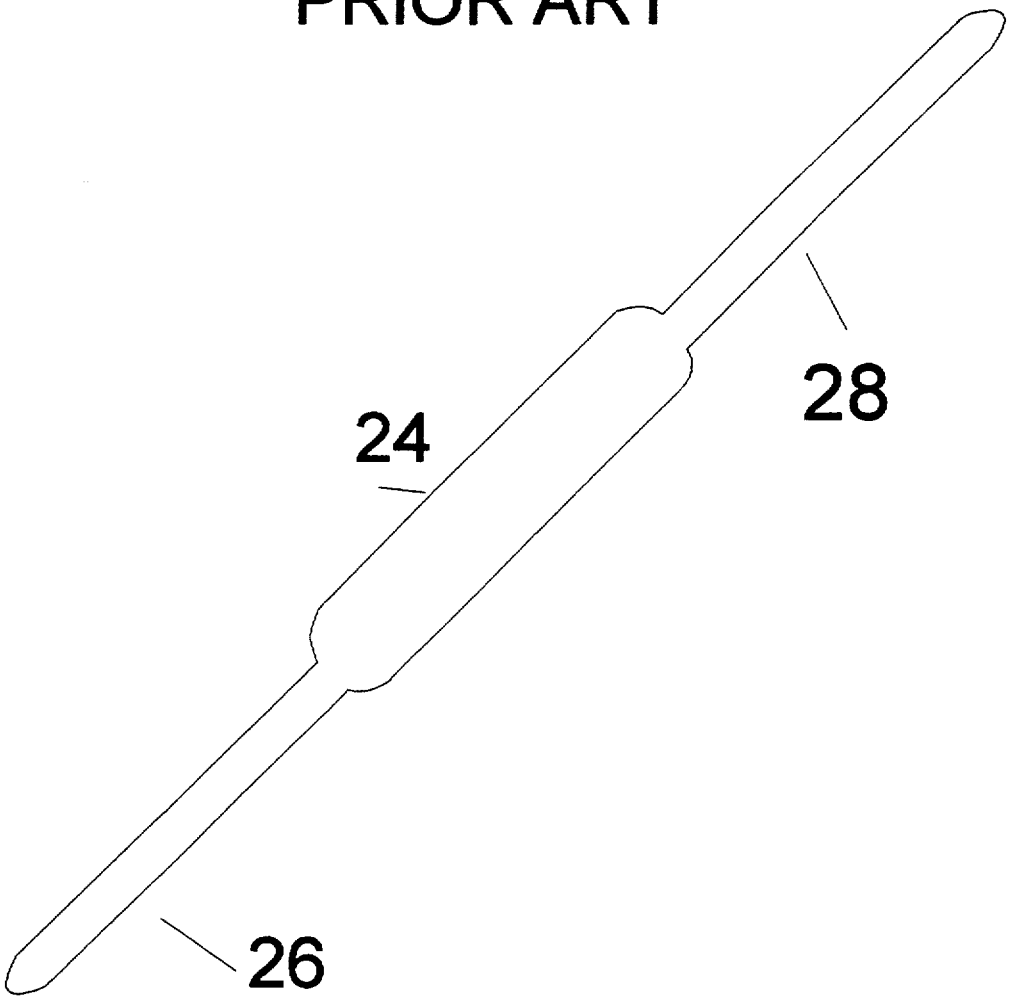
FIG. 4 PRIOR ART
FIG. 4 shows the fastener from the FIG. 1 file folder.

Referring to FIG. 4, details of the fastener 24, with its prongs 26 and 28, of the file folder 20 are shown.

Figure 5:
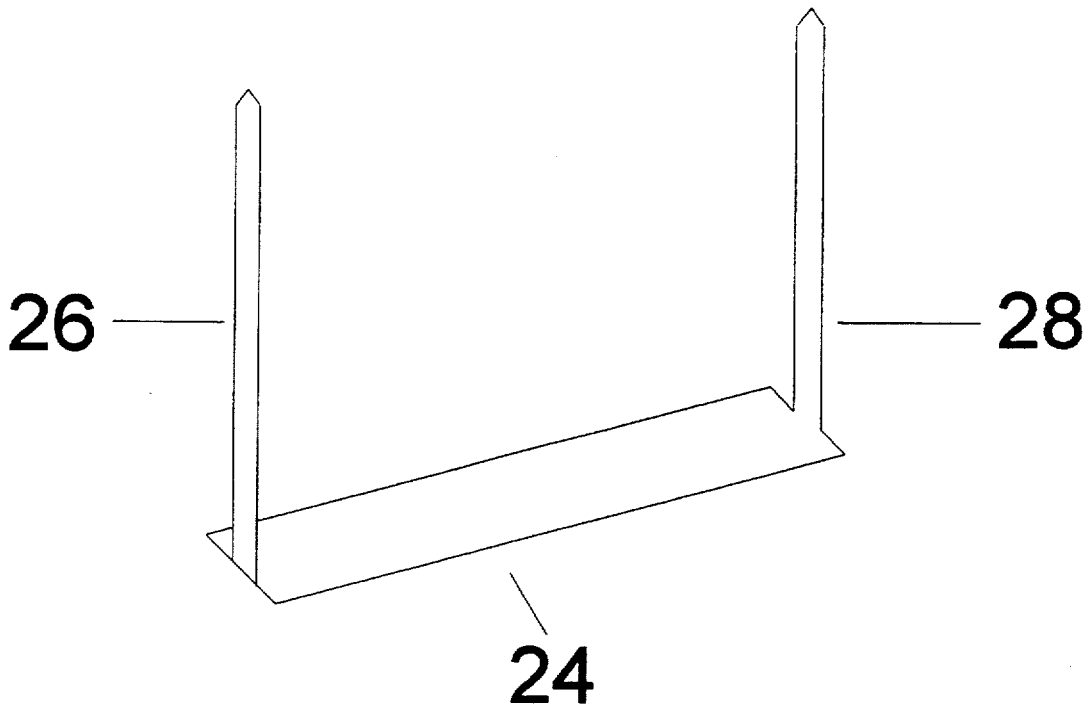
FIG. 5 PRIOR ART
FIG. 5 shows a side view of the fastener of FIG. 4 with the prongs of the fastener extended upwards.

Referring to FIG. 5, a perspective side view of the details of the fastener 24, with its prongs 26 and 28, of the file folder 20 are shown. As is customary in the file folders herein described, the width of prongs 26 and 28 are approximately the same size as the diameter of document holes 32.

Figure 6:
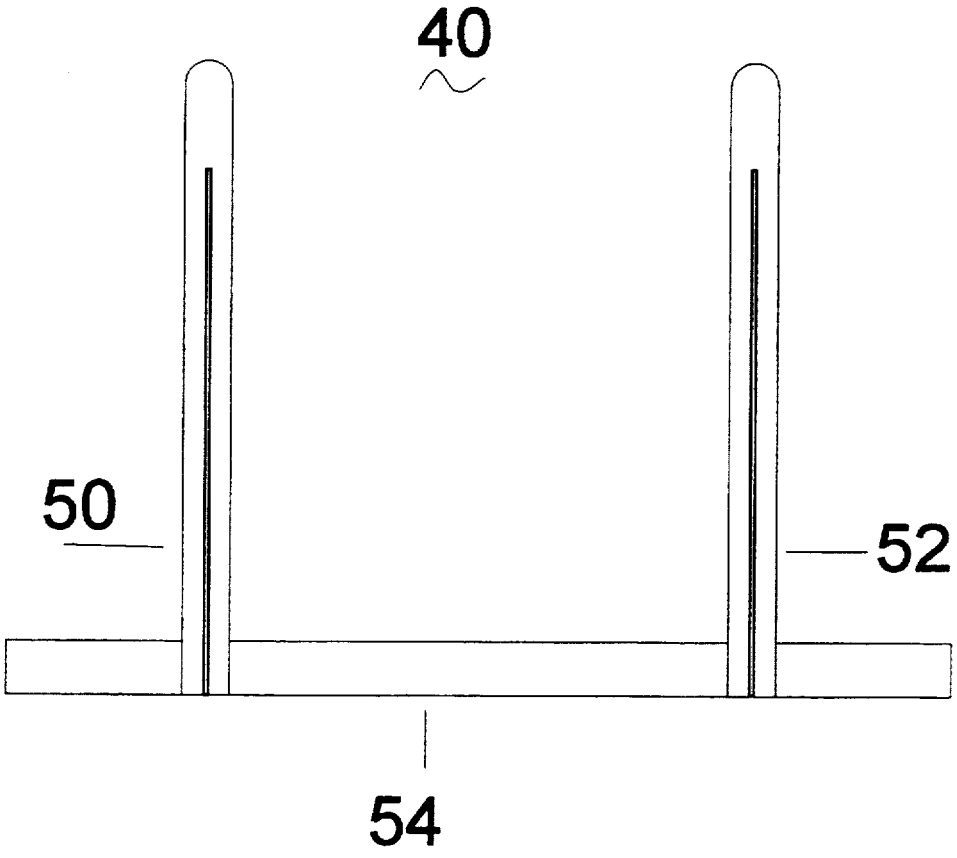
FIG. 6 is a front view of an embodiment of the invention.
Figure 7:
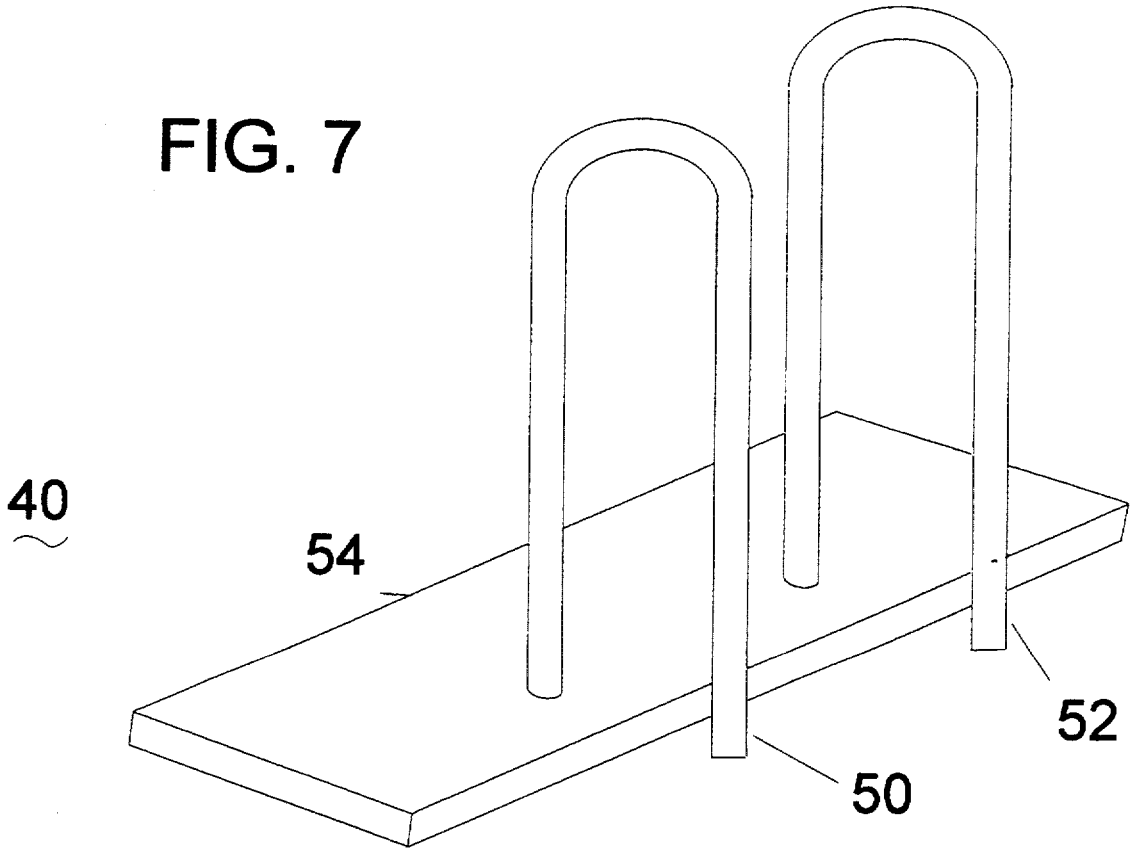
FIG. 7 is a perspective of an embodiment of the invention.

Referring to FIGS. 6–11, details of the preferred embodiments of a document removal device 40 are shown. In FIGS. 6 and 7, a document removal device 40 includes central section 54 which preferably connects two arms 50 and 52. The connecting section 54 and arms 50 and 52 formed of a material such as metal but not limited thereto. Plastics or any other materials which are sufficiently strong and rigid may be used to fabricate the invention. The preferred diameter of the illustrated cylindrical arms 50 and 52 is that which is less than that of the width of the prongs 26 and 28, and therefore is also less than that of the width of the document holes 32, thereby allowing for the easy passage of the arms 50 and 52 over the prongs 26 and 28, and through the document holes 32, and for the easy removal of documents from the file folder 20 and onto the document removal device 40 and for the return of said documents from the document removal device 40 in their proper order into the file folder 20.

Figure 8:
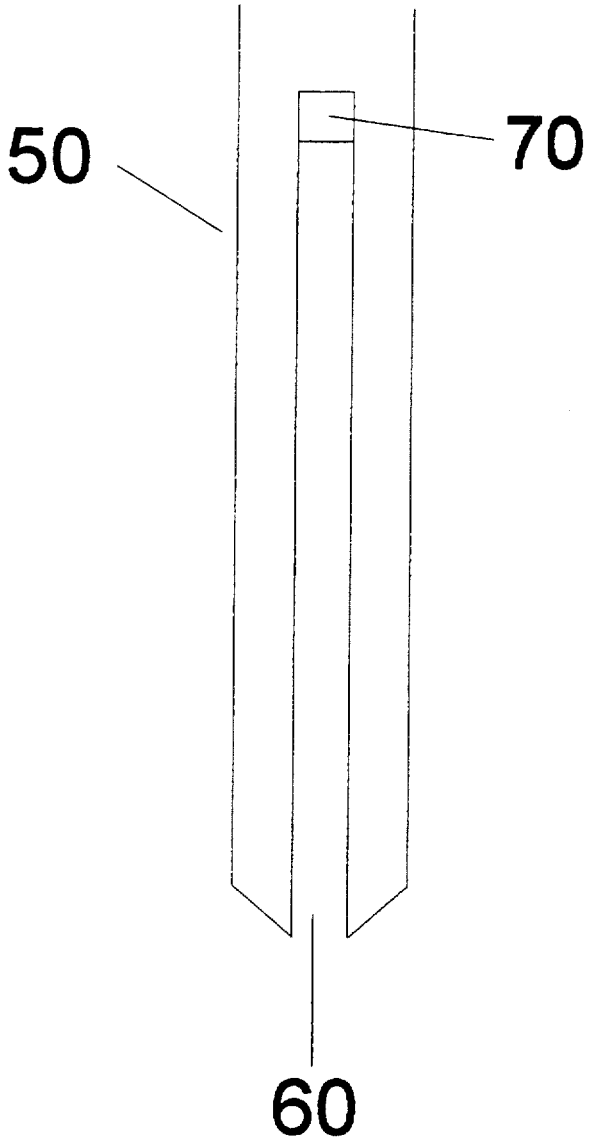
FIG. 8 is a front view of an arm which is a component of FIG. 6 and showing a slot and an interior element.

FIG. 8 shows a detailed front perspective of the arms 50 and 52 of a preferred embodiment of document removal device 40. Both arms 50 and 52 preferably have a vertical slot 60 extending the full diameter of the cylindrical member in width, with a height that may be approximately equal to the height of the prongs 26 and 28. The thickness of the arms may be greater than the thickness of said prongs 26 and 28 depending on the strength of the material used for the arms. The dimensions of the slot 60 of the arms 50 and 52 are preferably such that the slot 60 easily accepts and temporarily retains the prongs 26 and. 28 of the fastener 24. As the file folder 20 which is described herein may be constructed with prongs 26 and 28 having dimensions of various sizes, the dimensions of the slots 60 or the dimensions of the arms 50 and 52 of the document removal device 40 should not be limited in scope, but may vary accordingly.

Also shown in FIG. 8 is the side view of an interior element 70 that is preferably located at the upper end of slot 60 in particularly preferred embodiments of the present invention.

Figure 9:
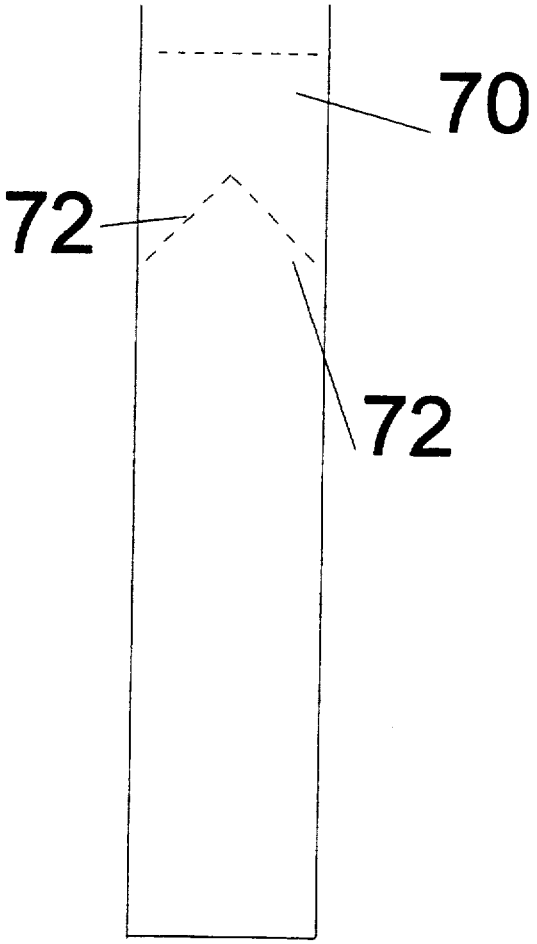
FIG. 9 is a side view of the arm of FIG. 8 showing the interior element of FIG. 8 in phantom.

FIG. 9 illustrates interior element 70 which preferably has an inverted syncline cut, identified along its edges by the numeral 72, on the bottom side of the element 70. In FIG. 9, interior element 70 has been inserted and permanently affixed by an adhesive or by other means into the slot 60 of one of the arms 50, 52. In other embodiments of the invention, the element 70 may be eliminated altogether by using a laser or conventional machining or other means to create an inverted syncline cut at the top end of the slot 60.

Figure 10:
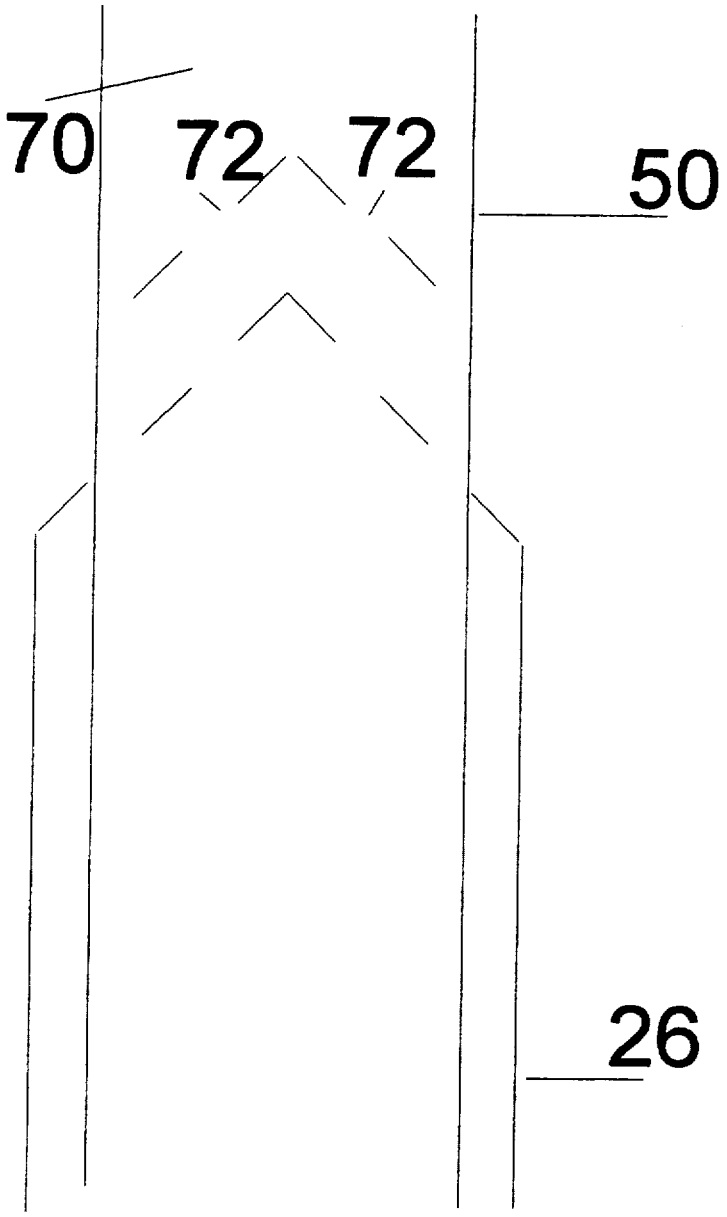
FIG. 10 is a side view of the arm of FIG. 8 showing a fastener prong inserted into the slot or hollow space, the tapered upper end of said prong fitting neatly into the hollow space created by the inverted syncline cut of the interior element of FIG. 8 in phantom.

FIG. 10 shows a side perspective of one of the arms 50, 52 of the document removal device 40 with a phantom view of the slot 60 and showing the interior element 70 inserted and affixed in slot 60 to form an inverted syncline cut at the top end of the slot 60. FIG. 10 also shows one of the arms 50, 52 with a prong 26, 28 from the fastener 24 inserted therein and the inverted syncline cut of the interior element accepting and retaining in place the tapered upper end of the prong 26, 28. Preferably, the syncline cut of element 70 is such that it engages the end of a prong 26, 28. Thus, when documents have been removed from the file folder 20 and placed onto the document removal device 40, the prongs 26 and 28, which have been captured by the arms 50 and 52, do not slide horizontally out of the slots 60 of the arms 50 and 52.

Figure 11:
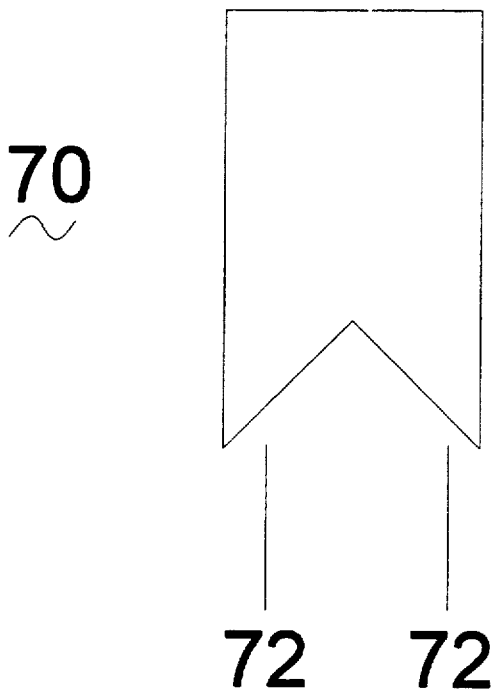
FIG. 11 is a front view of the interior element of FIG. 8 with an inverted syncline cut along the bottom edge.

FIG. 11 shows a front view of the interior element 70 with an inverted syncline cut 72 along the bottom side.

Operation

Referring now to FIGS. 1 through 10, the use of a preferred embodiment of the present invention will now be described.

As seen in FIG. 2, the first step in using a document removal device 40 is to erect the prongs 26 and 28 of the fastener 24 of the file folder 20. The arms 50 and 52 of a preferred embodiment of a document removal device 40 are then aligned over the prongs 26 and 28 so that the slot 60 (FIG. 8) of each arm 50, 52 is positioned directly over said prongs 26 and 28. The arms 50 and 52 are then lowered over the prongs 26 and 28 of the fastener 24 and through document holes 32. Thus, the entire document removal device 40 is preferably lowered as an integral unit until the prongs 26 and 28 are fully inserted into the respective slots 60 of each arm 50, 52.

When this operation is complete, the tapered end of each prong 26, 28 will preferably fit snugly into the interior hollow space created by the inverted syncline cut of the interior element 70 (FIG. 10). The snug fit of the tapered end of each prong 26, 28 in the hollow space created by the inverted syncline cut of the interior element 70 prevents the prongs 26 and 28 from moving horizontally out of their respective slots 60.

As shown in FIG. 3, to view a selected document the overlying documents are lifted up along the arms 50 and 52 of the document removal device 40 and turned over to slide down the rear length of the arms 50 and 52 of the document removal device 40.

To remove a selected document, or to insert an additional document, the document removal device 40 with the documents located thereon are then removed from the prongs 26 and 28 of the file folder 20 and the new document slipped onto the prongs 26 and 28 of the fastener 24, or a document removed. When the desired operation is completed, the document removal device 40 with its load of documents located thereon is then once again slipped over the prongs 26 and 28, and the documents on the document removal device 40 are turned over from the rear length of the arms 50 and 52 of the document removal device 40 and down the front length of the arms 50 and 52 of the document removal device 40 and onto the stack of documents contained in the file folder 20 in proper order and without misalignment of their holes on the fastener 24. The document removal device 40 is then removed off of the prongs 26 and 28 simply by lifting it up off of the prongs 26 and 28, and the prongs 26 and 28 are bent downward to the position seen in FIG. 1, once again holding intact all the documents within the file folder 20.

Accordingly, this invention can be used to easily view or remove selected documents retained in a file folder of the type wherein the punched papers contained within the folder are secured by a metal fastener. The advantages of this device are that:

- it permits easy viewing of a selected document without the necessity of weighing down the overlying documents when they are in a reverse, inverted position by allowing the overlying documents to be turned over two cylindrical members;
- it permits easy removal of a selected document or documents, or insertion of an additional document or documents, by allowing the overlying documents to be placed on the document removal device, whereupon the document removal device is temporarily disengaged from the file folder to permit removal of the overlying documents;
- it provides for the easy replacement of the removed overlying documents back to the file folder in proper order without misalignment of the holes;
- it provides a method of removing and returning overlying documents to the file folder without causing the fastener prongs to bend and deform, as under normal circumstances said prongs because of their malleability have a tendency to bend out of shape with repeated extractions and re-insertions of overlying documents.

The above description should not be construed as limiting the scope of the invention but as merely providing illustrations of some of the presently preferred embodiments of this invention. For example, the dimensions of the slot or the arm may vary, depending upon the dimensions of the fastener prongs contained in a file folder.

Thus the scope of the invention should be determined by the appended claims and their legal equivalents, rather than by the examples given.

What is claimed is:

1. An apparatus for viewing a selected document, or removing a selected document or documents from beneath one or more overlying documents, which documents are fastened in a file folder by a fastener having a plurality of manually malleable prongs, which prongs pass through holes punched in each of said documents, wherein the apparatus comprises:

an element, said element having a first arm, a second arm and a connecting section which joins said first and second element arms extending in a parallel space relationship from said connecting section in the same direction from said connecting section;

each of said first and said second arms of said element being a member having essentially a U shape, whereby the opposite end of the essentially U-shaped member which is joined at one end to a connecting section is not connected;

each of said first and said second arms of said element having a slot extending vertically from the bottom of the unconnected end of said first and said second arms and of sufficient height for the purpose of inserting a file folder prong into said slot.

2. An apparatus as claimed in claim 1 in which said slots of said first and said second arms have essentially inverted syncline upper ends to accommodate the tapered ends of said file folder prongs.

3. An apparatus for removing documents from a file folder comprising:

first and second arms; and a cross member connecting said first arm to said second arm so that said first arm is held in fixed parallel relationship to said second arm;

wherein each of said first and second arms has an outer cross section of a size and shape that conforms to holes formed in documents for storing documents in a file folder, and wherein each of said first and second arms has an opening formed on an end of said arm disposed away from said arms connection with said cross member, said opening in said arm having an inner cross section suitable for slidably engaging a prong of a file folder fastener.

4. The apparatus of claim 3 wherein said opening in each of said first and second arms extends along said arm for a distance at least as long as said prong of said file folder fastener.

5. The apparatus of claim 3 wherein said cross member is a flat plate and wherein each of said first and second arms extends in a substantially U-shaped arc from said cross member so that a portion of said opening of said first and second arms is disposed at a height substantially equal to that of said cross member.

6. The apparatus of claim 3 wherein said outer cross section of said first and second arms is cylindrical.

7. The apparatus of claim 3 wherein said inner cross section of said opening has a rectangular shape.

8. The apparatus of claim 3 wherein an end of said opening disposed away from an end of said first or second arm has a shape for engaging an end of said prong of said file folder fastener.

* * * * *